United States Patent [19]

Catanese et al.

[11] 4,115,719

[45] Sep. 19, 1978

[54] ELECTRON MULTIPLIER WITH HIGH ENERGY ELECTRON FILTER

[75] Inventors: Carmen Anthony Catanese, Rocky Hill, N.J.; James Berkeley Harrison, Jr., Morrisville, Pa.; Norman Lee Lindburg, Berkeley Heights, N.J.

[73] Assignee: RCA Corporation, New York, N.Y.

[21] Appl. No.: 729,281

[22] Filed: Oct. 4, 1976

[51] Int. Cl.[2] ..... H01J 43/10; H01J 43/18

[52] U.S. Cl. ..... 313/105 R; 313/400

[58] Field of Search ..... 313/105 R

[56] References Cited

U.S. PATENT DOCUMENTS

| | | | |
|---|---|---|---|
| 4,001,620 | 1/1977 | Endriz | 313/105 R |
| 4,029,984 | 6/1977 | Endriz | 313/105 R |

*Primary Examiner*—Robert Segal

*Attorney, Agent, or Firm*—E. M. Whitacre; D. S. Cohen; G. E. Haas

[57] ABSTRACT

An electron multiplier includes a plurality of staggered parallel dynodes disposed between two insulating vanes. The dynodes are disposed between a cathode at one end and a high energy electron filter at the other end. The electron filter includes at least two staggered filter bodies which extend into the space between the vanes. Each of the filter bodies extends slightly more than one-half the distance between the vanes so as to provide no straight path therethrough for high energy electrons, i.e., the filter is optically opaque. Between the dynodes closest to the cathode and the electron filter is a transition region. The transition region includes transition dynodes, having unequal widths and unequal spacings, and steering electrodes. In multiplier operation, the transition region functions to steer low energy electrons around the electron filter.

20 Claims, 6 Drawing Figures

ELECTRON MULTIPLIER WITH HIGH ENERGY ELECTRON FILTER

BACKGROUND OF THE INVENTION

This invention relates to electron multipliers, and particularly to a multiplier structure which includes a high energy electron filter.

Display devices have been proposed in which electron multipliers operated in a feedback mode are used to provide current to light up a cathodoluminescent screen. For example, see U.S. Pat. No. 3,904,923, entitled "CATHODOLUMINESCENT DISPLAY PANEL", issued Sept. 9, 1975 to J. Schwartz. In one such structure, the electron multiplier includes at least two vanes having a plurality of parallel dynodes disposed in staggered relation thereon with a cathode at one end. This structure is further described in copending application, Ser. No. 672,122, filed Mar. 31, 1976. In this structure, electrical potentials of increasing magnitude are applied to the successive multiplying dynodes so as to produce an electron beam at the multiplier output. Generally, the electron multiplier has an open structure to allow feedback which results in sufficiently high loop gain to produce sustained electron emission.

In order to vary the screen brightness in such a structure, it is necessary to include a set of modulation electrodes at the multiplier output. The simplest modulation structure operates as a gate wherein the modulation electrodes are made sufficiently negative so as to turn back that part of the multiplier output which is not desired at the screen. However, in order to achieve a high degree of brightness modulation, e.g. 100:1, with reasonable voltages (voltages equal to, or less than, the voltages between successive multiplying dynodes), it is necessary to filter out of the multiplier output all electrons except those electrons which originate from the last dynode. The reason that some form of filtering is necessary is that electrons which originate from earlier dynodes and skip the subsequent multiplier dynodes before reaching the multiplier output are highly energetic. These highly energetic electrons require high modulation voltages to prevent them from reaching the screen.

Thus, it would be desirable to develop a high energy electron filter for the previously described multiplier structure. Although structures such as grids and wires can be used in a high energy electron filter, these structures increase the complexity of construction. In addition to this structural constraint, any workable filter must also meet the practical electron optical constraint: namely that the filter must be closed enough to prevent the passage of high energy electroncs but, the surrounding electrical fields must be such so as to efficiently steer low energy electrons therethrough. As a result, it would be particularly desirable to develop a simple, easily constructed structure for such a filter which would also be compatible with the techniques employed in constructing the multiplier itself.

SUMMARY OF THE INVENTION

An electron multiplier includes at least two spaced substrates of electrically insulative material with a cathode at one end of the substrates. A plurality of parallel dynodes are on the surfaces of the substrates which face each other with the dynodes on one of the surfaces being in staggered relation to the dynodes on the other of the surfaces. At least one filter body extends from each of the facing surfaces of the substrates. The filter bodies constitute an electron filter which substantially prevents high energy electrons from passing therethrough. The filter bodies on the surfaces are in staggered parallel relation with respect to each other and in parallel reation with respect to the dynodes. Each of the filter bodies includes an electrically conductive surface. At least a portion of a transition region is disposed between the dynodes and the electron filter. The transition region includes transition dynodes, and steering electrodes. The transition dynodes and steering electrodes are in parallel relation to the dynodes and the filter bodies. At least some of the transition dynodes are in a staggered relation which is modified with respect to the other dynodes. The electron filter is disposed in proximate relation to at least some of the transition dynodes so that electrons emitted from the transition dynodes pass through the filter.

BRIEF DESCRIPTION OF THE DRAWINGS

In FIG. 4, electrical potentials are shown in parenthesis, relative dimensions are shown as coordinates referenced to 0 at the lower left hand corner of the Figure.

DETAILED DESCRIPTION OF THE INVENTION

Figure 1:
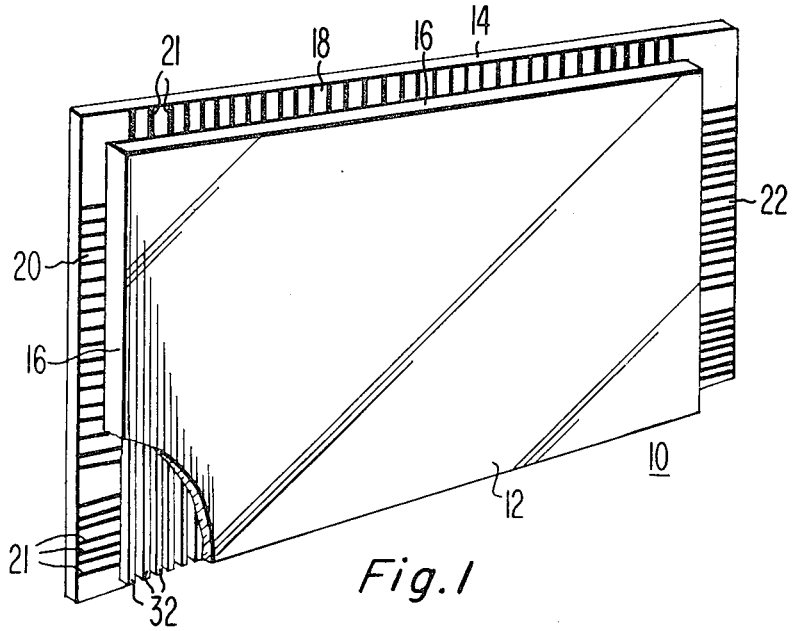
FIG. 1 is a partially cut-away perspective view of a flat panel image display device employing the electron multiplier of the present invention.

Referring initially to FIG. 1, one form of a flat image display device 10 of the present invention includes an evacuated glass envelope having a flat transparent viewing front panel 12 and a flat back panel 14. The front and back panels 12 and 14 are parallel and sealed together by peripheral side walls 16. The back panel 14 extends beyond the side walls 16 of the device 10 to form terminal areas 18, 20 and 22. Each of the terminal areas has a plurality of leads 21 which interconnect to internal components for activating and controlling the device. In one embodiment, the overall dimensions of the device 10 may be 84 cm high by 112 cm wide by 3 cm thick, with a viewing area of 76 cm by 102 cm.

Figure 2:
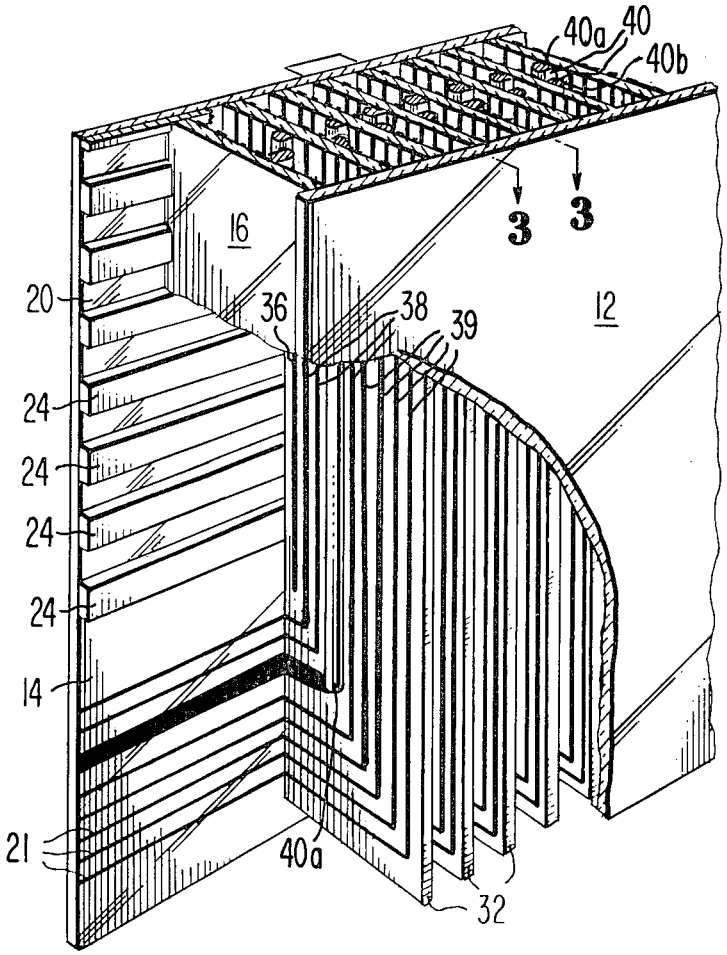
FIG. 2 is an enlargement of the cut-away section of FIG. 1.

The internal structure of the device 10 is shown in the cut-away view of FIG. 2. The back panel 14 has a plurality of cathode stripes 24 on its inside surface. Each stripe 24 is of a conductive material, such as metal, which may be overcoated with a thin layer of a material that provides a high electron emission under bombardment by a feedback species, such as ions or photons. For example, in the case of ion feedback, the emissive material may be MgO or BeO. The cathode stripes can be coated onto the back panel in the desired pattern by a variety of techniques, e.g. sputtering or evaporation of the component metal followed by photoetching and oxidation.

A plurality of spaced parallel vanes 32 extend between and are in perpendicular contact with the front and back panels 12 and 14. The vanes 32 are arranged orthogonal to the cathode stripes 24. Intrasupport of the front and back panels 12 and 14 is provided by the vanes 32. Each of the vanes 32 is formed from flat insulating material such as glass or ceramic.

The front panel 12 is preferably of glass and serves as the viewing faceplate of the device 10. The internal surface of the front panel 12 is covered with a plurality of phosphor stripes (not shown) which are capable of emitting light upon electron bombardment. The phosphor stripes are orthogonal to the cathode stripes 24 on the back panel 14. Each phosphor stripe extends parallel to and is disposed between each set of adjacent vanes 32. If the device 10 is intended to display a color image, the interior surface of the faceplate 12 may be coated with alternating red, green and blue light-emitting phosphor stripes.

Figure 3:
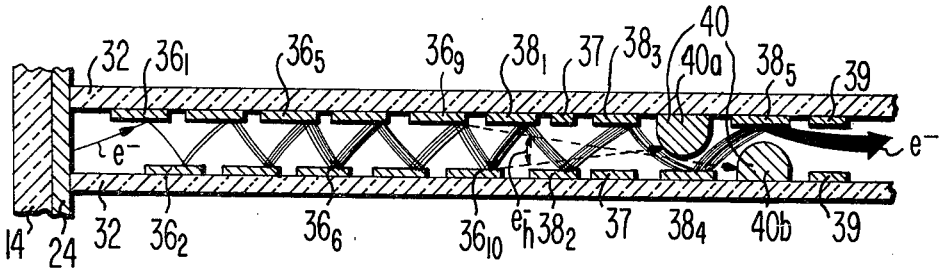
FIG. 3 is a sectional view taken along line 3—3 of FIG. 2 showing electron multiplication, electron beam steering, and electron filtering which occurs in the electron multiplier of the display device of FIG. 1.

Referring now to FIGS. 2 and 3, the electron multiplier structure of te present invention can be more fully described. Each set of the vanes 32 includes therebetween: a multiplier section, formed of staggered parallel multiplier dynodes 36 and 38, and steering electrodes 37; and a modulating, accelerating, and focusing section formed of electrodes 39. The dynodes 36 and 38, steering electrodes 37, and the modulating, focusing, and accelerating electrodes 39 are in parallel relation and extend orthogonally with respect to the cathode stripes 24. The multiplier section is positioned between a cathode stripe 24 at one end and high energy electron filter 40 at the other end, i.e. the output end. The electron filter 40 comprises two substantially identical staggered bodies **40*a* and 40*b* of electrically conductive material, e.g., aluminum, which extend from the opposing surfaces of two adjacent vanes 32. The two staggered filter bodies 40*a* and 40*b* are in parallel relation to each other and in parallel relation with respect to the dynodes 36 and 38. Each of the filter bodies 40*a* and 40*b* is smoothly curved and extends slightly more than one-half the distance between the vanes 32 so that the filter 40 is optically opaque, i.e., there is no straight path therethrough for high energy electrons which have skipped dynodes. Since each of the filter bodies 40*a* and 40*b* is made of conductive material, the filter bodies are hereinafter referred to as the filter electrodes 40*a* and 40*b***.

The multiplier dynodes 36 are positioned closer to the cathode stripes 24 than the multiplier dynodes 38. The multiplier dynodes 36 are substantially identical and uniformly spaced. Although only a few multiplier dynodes 36 are shown in FIG. 2, it should be noted that the number of dynodes may vary. For the purposes of this description, however, the multiplier structure is deemed to include ten identical multiplier dynodes $\mathbf{36}_{1 \ldots 10}$. The multiplier dynodes $\mathbf{38}_{1 \ldots 5}$, hereinafter termed transition dynodes 38, are disposed between the identical multiplier dynodes 36 and the high energy electron filter 40. It should be noted at this point that the last transition dynode $\mathbf{38}_5$ extends slightly beyond the electron filter 40. The transition dynodes 38 are not identical, i.e. they are not all the same width and they are not uniformly spaced. Thus, the transition dynodes 38 are disposed in a staggered relation which is modified with respect to the uniformly spaced multiplier dynodes 36. Included within the region of the transition dynodes 38 are the two steering electrodes 37. The steering electrodes 37 are not identical, i.e., they have different widths. The steering electrodes 37 are disposed in staggered relation with respect to each other but they are disposed in nonstaggered relation, i.e., facing relation, with respect to the transition dynodes $\mathbf{38}_2$ and $\mathbf{38}_3$ on the opposing surfaces of the vanes 32.

The last three transition dynodes ($\mathbf{38}_3$, $\mathbf{38}_4$, and $\mathbf{38}_5$) and the high energy electron filter 40 are arranged such that the two staggered filter electrodes **40*a* and 40*b* which constitute the filter 40 are included between the last three staggered transition dynodes ($\mathbf{38}_3$, $\mathbf{38}_4$, and $\mathbf{38}_5$). The last transition dynode $\mathbf{38}_5$, constitutes the output dynode for the multiplier structure included between the parallel vanes 32. Spaced from the last transition dynode $\mathbf{38}_5$ in a direction away from the cathode stripe 24 are a pair of modulating electrodes 39. The modulating electrodes 39 are strip shaped and are in parallel relation to the previously described multiplier dynodes 36, transition dynodes 38, steering electrodes 37, and filter electrodes 40*a* and 40*b***.

Generally, in the operation of the display device 10, the cathode stripes 24 provide input electrons for the dynodes 36 and 38 as shown in FIGS. 2 and 3. Each of the cathode stripes 24 can be considered a line source of electron beams. If the cathode stripe 24 is electrically more negative than the first dynode 36, electrons emitted by the stripe 24 will be attracted to the first dynode. However, if the cathode stripes is more positive than the first dynode, the emitted electrons will not reach the first dynode. Thus, the electron flow may be turned on or off in various regions of the multiplier by suitably biasing various cathode stripes 24. Increasingly positive voltages are applied to the multiplier dynodes 36 from the dynode closest to the cathode stripes 24 to the dynode closest to the front panel 12. For example, in the embodiment described herein, a dynode to dynode voltage increase of 200 volts permits acceptable multiplier operation. The multiplier is initially fired or started by primary electrons emitted from the cathode which may be caused by cosmic or other external radiation impinging thereon or by other causes. The electron current emitted from a negatively biased cathode stripe 24 is amplified through the very large gain of the dynodes 36 and 38.

The multiplication and filtering of high energy electrons provided by the structure of the present invention is shown schematically in FIG. 3. The electron beam ($e^-$) is multiplied as it traverses the identical staggered multiplier dynodes $\mathbf{36}_{1 \ldots 10}$, each of which is at a successively higher electrical potential. Then, the electron beam traverses the transition dynodes $\mathbf{38}_{1 \ldots 5}$ where it is steered around the filter electrodes **40*a* and 40*b*. That is, the transition dynodes $\mathbf{38}_{1 \ldots 5}$ together with the steering electrodes 37, function to alter the electron beam direction into the shallow trajectories needed to steer them around the filter 40 so as to strike the last transition dynode $\mathbf{38}_5$. In order to obtain this steering mechanism, it is necessary that the steering electrodes 37** be maintained at electrical potentials which are substantially the same as the electrical potentials on the opposing transition dynodes $\mathbf{38}_2$ and $\mathbf{38}_3$.

It can be seen in FIG. 3 that the presence of the opaque high energy electron filter 40 reduces the likeihood of high energy electrons ($e_h^-$) skipping the last few identical multiplier dynodes, e.g., dynodes $\mathbf{38}_{1 \ldots 4}$ and then reaching the modulating electrodes 39 since the electron filter provides no straight path therethrough. Thus, due to the presence of the high energy electron filter 40, substantially the only electrons which can pass through the electron filter are those relatively low energy electrons which are emitted from the transition dynode $38_4$ and directed towards the last transition dynode $38_5$.

Figure 4:
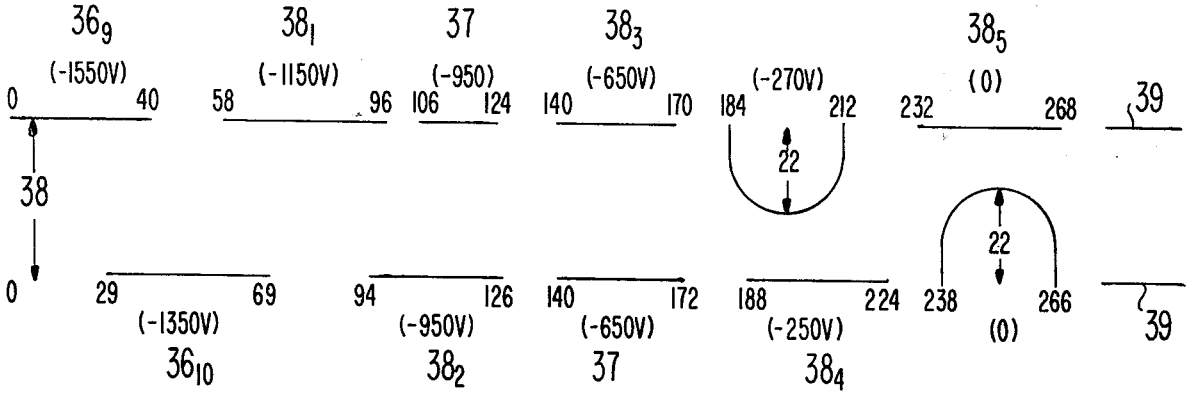
FIG. 4 is a sectional view, taken as in FIG. 3, showing a preferred embodiment including relative dimensions and electrical potentials.
Figure 5:
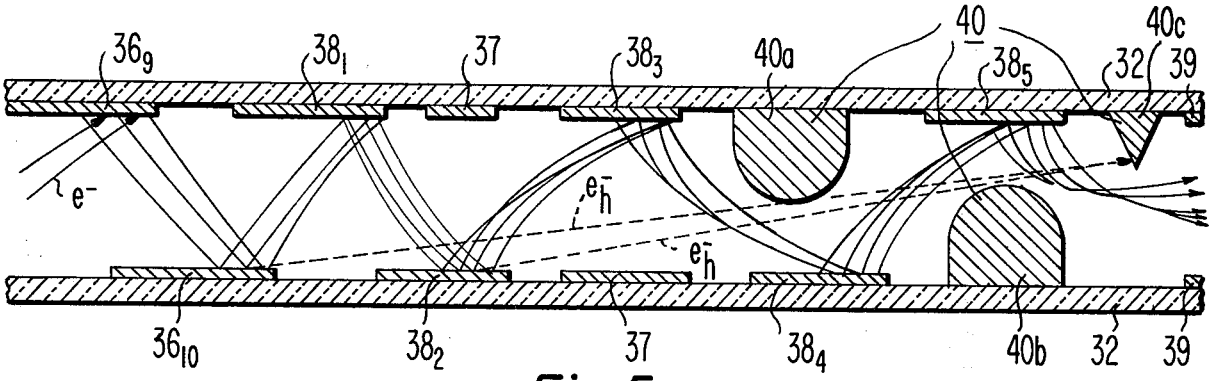
FIGS. 5 and 6 are portions of sectional views, taken as in FIG. 3, showing variations of the electron multiplier of the present invention.

A preferred embodiment, including relative dimensions and electrical potentials is shown in FIG. 4. Note that of the ten identical multiplier dynodes $36_{1 \ldots 10}$, only dynodes $36_9$ and $36_{10}$ are shown. In FIG. 4, electrical potentials are shown in parenthesis, relative dimensions are shown in coordinates referenced to 0 at the lower left hand corner of the Figure. With regard to the preferred embodiment shown in FIG. 4, it should be mentioned that, in order to enhance the filtering, it may be desirable to add an additional filter body 40c which may be of a conductive material, e.g., aluminum, as shown in FIG. 5. The filter body 40c is parallel to the filter bodies 40a and 40b and extends about one-third the distance between the vanes 32. The filter body 40c can also be referred to as the filter electrode 40c.

The structure shown in FIG. 5 further reduces the likelihood of high energy electrons ($e_h^-$) passing through the filter 40 and into the modulating area. That is, the third filter electrode 40c is shaped so as to filter out those high energy electrons ($e_h^-$) which might otherwise travel directly from multiplier dynode $36_{10}$ and transition dynode $38_2$ through the filter electrodes 40a and 40b. This can be seen in FIG. 5 in which these high energy electron trajectories ($e_h^-$) are shown as dashed lines. Note that the triangular shape of the filter electrode 40c is but one of many shapes which are possible. However, we have found that the triangular shape is particularly compatible with the electrical potential contours near the filter electrodes 40a and 40b.

The multiplying, filtering and modulating structure disposed on the vanes 32 can be simply constructed through large area processing techniques. A preferred construction technique includes bonding a foil to a substrate through the application of heat, an electric field, and pressure. The foil should be of material which can be activated to have a high secondary emission coefficient ($\delta$). One suitable foil material is an alloy of magnesium and aluminum. The desired pattern including the identical multiplier dynodes 36, transition dynodes 38, steering electrodes 37, and modulating electrodes 39, can then be embossed and defined in the foil. The embossing of the foil can be performed either before or after bonding the foil to the substrate. This construction technique is more fully disclosed in copending patent application, Ser. No. 681,695, entitled, "Method of Forming Dynodes", filed Apr. 29, 1976. It should be noted that in some cases it is preferable to form the filter electrodes 40a . . . *c* after the multiplier dynodes 36, transition dynodes 38, steering electrodes 37 and modulating electrodes 39 have been formed by an area processing technique. In such a case, the filter electrodes 40a . . . *c* can be separately formed, e.g., embossed.

Figure 6:
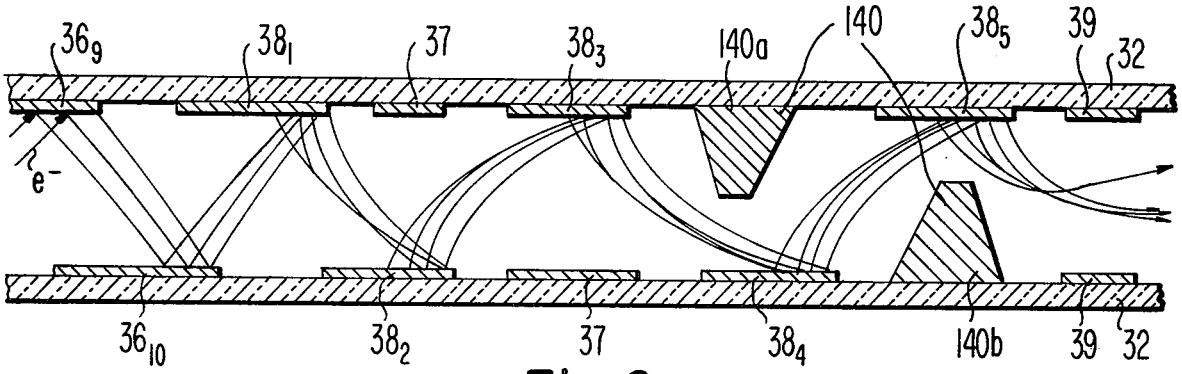

It should be noted that the dimensions and electrical potentials of the preferred embodiment shown in FIG. 4 are not critical; small variations can be made with no significant degradation. In any variation, however, it is necessary to employ transition dynodes together with steering electrodes in order to get the electron beam into the shallow trajectories required for passage through the high energy electron filter. The shapes of the filter electrodes are not critical in the operation of the structure although it is desirable that at least two of the filter electrodes extend through about six-tenths of the distance between the vanes. For example, as shown in FIG. 6, filters 140 with a more triangular shape are also acceptable as long as the triangularly shaped bodies 140a and 140b extend a sufficient distance into the space between the vanes 32 so as to block substantially all electrons other than those which originate at the transition dynode which precedes the last transition dynode.

Also, although convenient, it is not necessary that any two of the filter electrodes be substantially identical. Particularly preferable, in any variation, is to employ a filter structure in which the filter electrodes are as wide as they are high. Meeting this requirement allows for easy buildability of the structure. Further, the filter bodies need not be made of electrically conductive material. It is only necessary that the filter bodies include a surface which is electrically conductive. Thus, for example, the filter bodies may be made of glass coated with a conductive material. In such a case, the coated filter body functions as the filter electrode.

Furthermore, although the electron multiplier of the present invention has been described as including ten identical dynodes ($36_{1 \ldots 10}$) and five transition dynodes ($38_{1 \ldots 5}$), these numbers are exemplary only. Also, if desired, the structure may include additional dynodes which are neither identical dynodes nor transition dynodes. For example, some of the dynodes may be provided with nonplanar structure such as ion shields and/or confinement bumps. The ion shields are useful in preventing ion feedback from striking some of the dynodes. Confinement bumps which are periodically disposed along the lengths of the dynodes function to prevent spreading of the electron beam in a direction parallel to the length of the dynodes. However, it should be noted that, in any variation, it is desirable that the structure include a plurality of dynodes which are substantially identical in the sense of having at least approximately equal widths. Thus, dynodes having approximately equal widths are considered to be substantially identical although they may differ in other respects such as thickness or shape.

In addition, it should also be noted that the transition dynodes of the electron multiplier of the present invention need not be both unequal in width as well as unequally spaced. For example, if desired, transition dynodes having equal widths can be employed. However, in such a structure, additional focusing structure, e.g., auxilary electrodes, may be required to direct the electrons into the shallow trajectories needed to pass through the high energy electron filter.

An advantage of the high energy electron filter of the present invention is that the relatively high filter electrodes effectively isolate the electron optics between the cathode stripe and the filter from the electron optics beyond the filter. This is a significant result as it makes possible the variation of voltage within the multiplier section with no significant perturbation on the output optics. That is, variation of voltage in the multiplier section causes substantially no perturbation in the later modulation and focusing of the beam. This is particularly useful in a case where, for example, the multiplier gain slowly decreases as a function of operating time. In such a case, the voltage at each of the dynodes can be increased to restore the gain without affecting the optics beyond the multiplying electrodes.

We claim:

1. An electron multiplier, comprising:

at least two spaced substrates of electrically insulative material;

a cathode at one end of said substrates;

a plurality of parallel dynodes on the surfaces of said substrates which face each other, said dynodes on one of said surfaces being in staggered relation to said dynodes on the other of said surfaces;

an electron filter including at least one filter body which extends from each of said surfaces of said substrates a sufficient distance so as to substantially prevent high energy electrons from passing through said filter, said filter bodies on said surfaces being in staggered parallel relation with respect to each other and in parallel relation with respect to said dynodes, each of said filter bodies including an electrically conductive surface; and a transition region at least a portion of which is disposed between said dynodes and said electron filter, said transition region including transition dynodes and steering electrodes on said substrates in a parallel relation to said dynodes and said filter bodies, at least some of said transition dynodes being in a staggered relation which is modified with respect to said dynodes, said steering electrodes on each substrate being in a facing relation with respect to the transition dynodes on the other substrate, there being at least three consecutive staggered transition dynodes and said electron filter being disposed between said transition dynodes so that electrons emitted from one of said transition dynodes pass through without striking said filter.

2. An electron multiplier in accordance with claim 1 in which said dynodes are substantially identical.

3. An electron multiplier in accordance with claim 1 in which at least some of said transition dynodes have widths which are unequal.

4. An electron multiplier in accordance with claim 1 in which said electron filter bodies have widths which are about equal in magnitude to the distance they extend from said surfaces of said substrates.

5. An electron multiplier in accordance with claim 1 in which said filter bodies are smoothly curved.

6. An electron multiplier in accordance with claim 5 in which said filter bodies each extend about 0.6 of the distance between said spaced substrates.

7. An electron multiplier in accordance with claim 5 in which said electron filter includes a third filter body disposed to one side of said two filter bodies in a direction away from said cathode, said third filter body being shaped so as to reduce the likelihood of high energy electrons passing through said electron filter.

8. An electron multiplier in accordance with claim 1 which includes modulating means disposed to one side of said electron filter in a direction away from said cathode.

9. An image display device, comprising:

an evacuated envelope including a transparent front panel and a back panel spaced from said front panel, said front panel having a cathodoluminescent screen thereon;

means for generating a plurality of substantially parallel line beams of electrons; and a plurality of spaced substantially parallel vanes disposed between said front and back panels, said vanes being substantially orthogonal to said line beams, said vanes including therebetween:

(a) a plurality of parallel dynodes on the surfaces of said vanes which face each other, said dynodes on one of said surfaces being in staggered relation to said dynodes on the other of said surfaces;

(b) an electron filter including at least one filter body which extends from each of said surfaces of said vanes a sufficient distance so as to substantially prevent high energy electrons from passing through said filter, said filter bodies on said surfaces being in staggered parallel relation with respect to each other and in parallel relation with respect to said dynodes, each of said filter bodies including an electrically conductive surface; and (c) a transition region at least a portion of which is disposed between said dynodes and said electron filter, said transition region including transition dynodes and steering electrodes on said substrates in a parallel relation to said dynodes and said filter bodies, at least some of said transition dynodes being in a staggered relation which is modified with respect to said dynodes, said steering electrodes on each vane being in a facing relation with respect to the transition dynodes on the other vane, there being at least three consecutive staggered transition dynodes and said electron filter being disposed between said transition dynodes so that the electrons emitted from one of said transition dynodes pass through without striking said filter.

10. An image display device in accordance with claim 9 in which said dynodes are substantially identical.

11. An image display device in accordance with claim 9 in which at least some of said transition dynodes have widths which are unequal.

12. An image display device in accordance with claim 9 in which said electron filter bodies have widths which are about equal in magnitude to the distance they extend from said surfaces of said vanes.

13. An image display device in accordance with claim 9 in which said electron filter comprises two of said filter bodies.

14. An image display device in accordance with claim 13 in which said filter bodies are smoothly curved.

15. An image display device in accordance with claim 13 in which there are at least three consecutive staggered transition dynodes and said electron filter is between said transition dynodes.

16. An image display device in accordance with claim 13 in which said filter bodies each extend about 0.6 of the distance between said spaced vanes.

17. An image display device in accordance with claim 13 in which said electron filter includes a third filter body disposed to one side of said two filter bodies in a direction away from said back panel, said third filter body being shaped so as to reduce the likelihood of high energy electrons passing through said electron filter.

18. An image display device in accordance with claim 9 which includes modulating means disposed to one side of said electron filter in a direction away from said back panel.

19. The electron multiplier as in claim 1, wherein the transition dynodes and steering electrodes in the portion of the transition region between said dynodes and said electron filter are alternately disposed on each substrate.

20. The image display device as in claim 9, wherein the transition dynodes and steering electrodes in the portion of the transition region between said dynodes and said electron filter are alternately disposed on each substrate.

* * * * *